US009951559B2

(12) United States Patent
Ukonjärvi

(10) Patent No.: US 9,951,559 B2
(45) Date of Patent: Apr. 24, 2018

(54) ROTATION UNIT, ROCK DRILLING UNIT AND METHOD FOR ROCK DRILLING

(71) Applicant: Sandvik Mining and Construction Oy, Tampere (FI)

(72) Inventor: Tapio Ukonjärvi, Tampere (FI)

(73) Assignee: Sandvik Mining and Construction Oy, Tamper (FI)

( * ) Notice: Subject to any disclaimer, the term of this patent is extended or adjusted under 35 U.S.C. 154(b) by 222 days.

(21) Appl. No.: 14/879,289

(22) Filed: Oct. 9, 2015

(65) Prior Publication Data

US 2016/0102498 A1 Apr. 14, 2016

(30) Foreign Application Priority Data

Oct. 9, 2014 (EP) ..... 14188228

(51) Int. Cl.
*E21B 3/04* (2006.01)
*E21B 3/02* (2006.01)

(52) U.S. Cl.
CPC . *E21B 3/04* (2013.01); *E21B 3/02* (2013.01)

(58) Field of Classification Search
CPC ... E21B 3/02; E21B 3/04; E21B 7/024; E21B 7/025
See application file for complete search history.

(56) References Cited

U.S. PATENT DOCUMENTS 2,019,761 A * 11/1935 Mitchell ..... E21B 3/02 15/104.09
2,566,084 A * 8/1951 Esseling ..... E21B 3/02 173/146
3,736,993 A 6/1973 West
3,892,107 A * 7/1975 Handen ..... B25D 17/08 173/104
4,298,073 A 11/1981 Yates
4,582,145 A 4/1986 Pekka
4,637,475 A * 1/1987 England ..... E21B 7/024 173/193
4,971,158 A 11/1990 Pekka
2013/0192895 A1* 8/2013 Krohn ..... E21B 3/02 175/57
2013/0220701 A1* 8/2013 Crowley ..... E21B 17/073 175/40
2014/0034387 A1 2/2014 Ukonjaervi et al.

FOREIGN PATENT DOCUMENTS

CN 201141280 Y 10/2008
CN 101981269 A 2/2011
CN 102202831 A 9/2011
CN 203383730 U 1/2014
JP 2002536576 A 10/2002
JP 2014510862 A 5/2014
KR 1020140009490 A 1/2014
WO 2011092377 A1 8/2011

* cited by examiner

*Primary Examiner* — James G Sayre
(74) *Attorney, Agent, or Firm* — Corinne R. Gorski

(57) ABSTRACT

A rotation unit includes a main shaft that is rotated around its longitudinal axis by a rotating motor. The main shaft includes a tubular outer shaft and an inner shaft arranged inside the outer shaft. The outer shaft is supported by a body of the rotation unit and is arranged to transmit axial forces, whereas the inner shaft is arranged to transmit rotation and torque. A rock drilling unit and method for rock drilling is also provided.

13 Claims, 4 Drawing Sheets

ROTATION UNIT, ROCK DRILLING UNIT AND METHOD FOR ROCK DRILLING

RELATED APPLICATION DATA

This application claims priority under 35 U.S.C. §119 to EP Patent Application No. 14188228.2, filed on Oct. 9, 2014, which the entirety thereof is incorporated herein by reference

BACKGROUND

The disclosure relates to a rotation unit for rock drilling, wherein the rotation unit has no percussion device. The purpose of the rotation unit is to generate the required rotation for drilling equipment to be connected thereto, at the outermost end of which equipment there is a drill bit for breaking rock. Also, axial forces are transmitted through the rotation unit. Further, the disclosure relates to a drilling unit and a method for rock drilling.

Holes can be drilled in rock by means of various rock drilling machines. Drilling may be performed with a method combining percussions and rotation (percussive drilling), or drilling may be based on mere rotation without a percussive function (rotary drilling). Further, percussive drilling may be classified according to whether the percussion device is outside the drill hole or in the drill hole during the drilling. When the percussion device is outside the drill hole, the drilling is usually called top hammer drilling, and when the percussion device is in the drill hole, the drilling is typically called down-the-hole drilling (DTH). In a top hammer drilling machine, the percussion device and the rotation device are combined into one entity, whereas in a rotary drilling machine and DTH drilling machine, there is a rotation unit which is completely without a percussion device. This disclosure is directed to such a rotation unit without a percussion device and to the use thereof.

The rotation unit includes a main shaft that is rotated around its longitudinal axis. Rotation and torque is generated by a rotating motor connected to the main shaft through a gear system. During drilling the rotation unit is fed axially by means of a feed device in the drilling direction and the return direction. Thus, the main shaft of the rotation unit is subjected to rotational and axial forces. In current solutions, durability of the main shafts and rotation units is a problem.

SUMMARY

An aspect of this disclosure to provide a novel and improved rotation unit, rock drilling unit and method for rock drilling.

The rotation unit according to the disclosure has a main shaft including a tubular outer shaft and an inner shaft arranged inside the outer shaft. An outer surface of the outer shaft is provided with axial support surfaces for transmitting the axial forces. The inner shaft is provided with first transmission members at a rear end for receiving torque from the rotating motor and a front end of the inner shaft is provided with second transmission members for transmitting the torque to the drilling equipment.

The method according to the disclosure is characterized by using in the drilling a rotation unit, the main shaft of which is provided with a tubular outer shaft, and wherein an inner shaft is arranged inside the tubular outer shaft, transmitting the torque purely through the inner shaft, and transmitting the axial forces purely through the outer shaft.

A disclosed solution is that the main shaft of the rotation unit is composed of two shaft pieces. Thus, the main shaft has an outer shaft and an inner shaft. The outer shaft has a tubular configuration and the inner shaft is located inside the tubular outer shaft. The outer shaft is provided with suitable axial support surfaces or elements for transmitting axial forces between a body of the rotation unit and drilling equipment. The inner shaft includes transmission members at a rear and front end for receiving and transmitting torque.

An advantage of the disclosed solution is that the main shaft has two dedicated separate shaft pieces for two different purposes, namely for transmitting axial forces and torque. The outer shaft may be designed, dimensioned and supported so that it endures axial loadings well. On the other hand, the inner shaft may be designed and constructed so that the desired rotation and torque may be transmitted through without problems. Thus, the disclosed solution improves durability and reliability of the rotation unit. The use of the dedicated shaft pieces removes a need to make compromises in the structure of the main shaft.

According to an embodiment, the front end and the rear end of the inner shaft include longitudinal splines, or set of grooves, for transmitting torque on their outer surfaces. The splines transmit torque and allow axial movement. Thanks to the splines servicing of the rotation unit is easier since mounting and dismounting of the inner shaft needs no special tools or skills.

According to an embodiment, the opposite end portions of the inner shaft includes splines for transmitting rotation and torque. The splines of the inner shaft and their mating surfaces are not subjected to relative axial movement during the use of the rotation unit, whereby durability of the splines is improved. The outer shaft is configured to support the structure of the main shaft so that no axial movement is subjected to the inner shaft.

According to an embodiment, the inner shaft is removable from the rotation unit without dismantling the outer shaft. The inner shaft may be removed from the front side end of the rotation unit after a rotation hub, front cover or any other structure, which is located at the front end of the rotation unit, is first removed. The inner shaft may include splines serving as transmission members, which splines facilitate dismounting. The inner shaft may be without any bearings, which also makes the removal of the inner shaft fast and easy.

According to an embodiment, the inner shaft has a slender structure. According to the practical tests the slender inner shaft has shown to be advantageous regarding durability when the shaft is subjected to rotation movement comprising impacting or pulsating rotation components. Formation of such pulsating rotation components are typical for DTH—drilling, for example.

According to an embodiment, the outer shaft has a first maximum diameter and the inner shaft has a second maximum diameter. The first maximum diameter of the outer shaft is at least double relative to the second maximum diameter of the inner shaft. The inner shaft having a slender structure endures well pulsating torque. Regarding capability to transmit axial forces it is advantageous for the outer shaft to have as great outer diameter as allowed by the basic construction of the rotation unit.

According to an embodiment, the front end of the outer shaft is provided with a flange or corresponding element comprising an axial fastening surface facing in the drilling direction. The axial fastening surface may transmit axial forces and allow a rotation hub or drilling equipment to be connected to the outer shaft. The fastening surface may include connecting threads, fast coupling elements or any other connecting means or elements for mounting a frontal element.

According to an embodiment, a connecting point between the inner shaft and the following frontal element, such as a hub or drilling equipment, is located inside the outer shaft. Thus, the front end of the inner shaft is located inside the outer shaft at a distance from the front end of the outer shaft. On the other hand, the rear end of the inner shaft may be arranged to protrude from the rear end of the outer shaft. In this embodiment, a connection element of the connectable frontal element is located between the inner surface of the outer shaft and an outer surface of the inner shaft, and may thus be well supported.

According to an embodiment, axial movement of the outer shaft relative to the body of the rotation unit is prevented. The outer shaft is provided with bearings on the outer surface, which bearings may serve as axial support elements transmitting axial forces between the body and the outer shaft. The bearings of the outer shaft may be arranged to support the outer shaft to the body substantially without axial movement or clearance. When the axial movement of the outer shaft is prevented, wearing of the components of the rotation unit may be degreased. Thus, relative movement between the rotation transmission members of the inner shaft and mating components may be decreased, for example.

According to an embodiment, the outer shaft is bearing mounted to the body with rolling bearings only. The outer shaft may be supported to the body by means of two rolling bearings, which bearings support the outer shaft in the radial and axial directions. The outer shaft may be supported so that the outer shaft is substantially without axial movement or clearance.

According to an embodiment, the inner shaft inside the outer shaft is without direct connection to the outer shaft. The inner shaft may simply pass through the basic structure of the tubular outer shaft.

According to an embodiment, the outer shaft is provided with bearings on the outer surface and the inner shaft is without any bearings. Since the inner shaft has no bearings, dismantling and mounting of the structure is fast and easy.

According to an embodiment, the inner shaft is subjected only to torque during use of the rotation unit. Due to this feature, the inner shaft may be dimensioned to be slender, and still, durability of the inner shaft is good. The outer shaft receives and transports the axial forces.

According to an embodiment, at the front end of the rotation unit is a rotation hub, which is a separate piece connectable to frontal fastening means of the main shaft. A front end portion of the rotation hub includes fastenings for fastening drilling equipment such as drilling tubes. A rear end portion of the rotation hub includes a rear sleeve portion, which is arranged inside the front portion of the outer shaft and includes longitudinal splines, or corresponding elements, on an inner surface of the rear sleeve portion. The splines of the rotation hub are in contact with splines of the inner shaft. For connection to the outer shaft, the rear end portion of the rotation hub includes a second fastening surface allowing connection to a first fastening surface of the outer shaft. The second fastening surface of the hub may be an axial surface facing the outer shaft and may be formed in a flange, for example. Thus, the splines of the rotation hub transmit torque and the second fastening surface transmits axial forces.

According to an embodiment, the front end of the rotation unit is provided with a rotation hub, which serves as an adapter or coupling element between the shafts and the connectable drilling equipment. The rotation hub includes at least one channel for conducting pressure medium to the drilling equipment. Around the rotation hub may be a frontal housing through which the pressure medium may be fed. The pressure medium may be fed to an inner pressure medium space of the frontal housing and the rotation hub may include one or more transverse channels, which are in pressure medium contact with the inner space. Thus, the rotation hub has one or more channels for conducting pressure medium from the pressure space into a centre channel in the rotation hub and further along it to the drilling equipment to be connected to the rotation hub. The pressure medium may be pressurized air, for example.

According to an embodiment, the inner shaft is provided with at least one axial channel for conducting pressure medium to the drilling equipment. If the rotation unit includes a rotation hub connected to the front end of the rotation unit, then the rotation hub is also provided with an axial channel allowing the pressure medium to be fed to the drilling equipment.

According to an embodiment, between the outer shaft and the inner shaft is an annular channel for conducting pressure medium towards the drilling equipment. Thus, the outer diameter of the inner shaft and the inner diameter of the outer shaft are dimensioned so that the desired annular channel is formed.

According to an embodiment, the rotating motor of the rotation unit is positioned on the side of the rear end of the main shaft and the rotating motor and the main shaft are arranged on the same axial line.

According to an embodiment, the rotating motor is configured to rotate the inner shaft via a transmission system, which includes a gear system and/or transmission members. The rotating motor and the transmission system are positioned at the rear end of the main shaft.

According to an embodiment, the rotating motor is arranged to transmit rotation via a planetary gear to the inner shaft. The planetary gear may be physically rather small and also short in the axial direction, whereby it is easy to arrange.

According to an embodiment, the rock drilling unit includes a carriage which is moved on a feed beam by means of a feed device. The body of the rotation unit is immovably attached to the carriage. Thus, the rotation unit and its body always move along with the carriage.

According to an embodiment, the rotation unit is intended for rotary drilling, in which drilling takes place by the effect of mere rotation and feed force without any percussion device.

According to an embodiment, the rotation unit is intended for DTH drilling, in which the rotation unit and the percussion device are in opposite end portions of the drilling equipment. Hence, there is no percussion device in the rotation unit but it is in connection with the drilling equipment. The drill bit is typically attached directly to the percussion device.

According to an embodiment, the rotating motor is a hydraulic motor.

According to an embodiment, the rotating motor is an electric motor.

According to an embodiment, the rotation unit does not include a gear system at all but torque is transmitted to the main shaft by means of other transmission members. The rotating motor is of the type called a direct drive motor. The rotation speed and torque of the direct drive rotating motor can be controlled in a versatile and accurate manner. The direct drive motor can be dimensioned in such a way that no separate gear system is needed. Motors of this type are available as hydraulically operated and electrically operated motors. As the gear system can be left out of the rotation unit, there are fewer components to be maintained and subject to damage. Further, the rotation unit can be made smaller.

The foregoing summary, as well as the following detailed description of the embodiments, will be better understood when read in conjunction with the appended drawings. It should be understood that the embodiments depicted are not limited to the precise arrangements and instrumentalities shown.

BRIEF DESCRIPTION OF THE DRAWINGS

In the figures, some embodiments of the disclosure are shown simplified for the sake of clarity. Like reference numerals refer to like parts in the figures.

DETAILED DESCRIPTION

Figure 1:
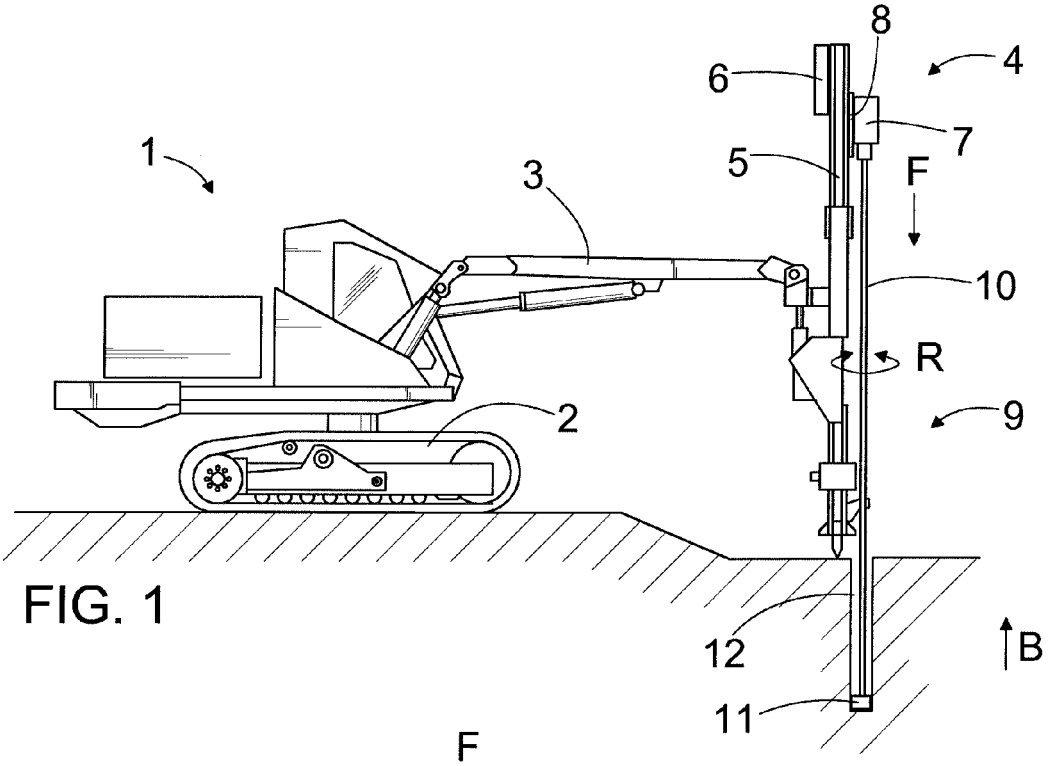
FIG. 1 shows schematically a rock drilling rig provided with a rotation unit for rotating drilling equipment around its longitudinal axis.

FIG. 1 shows a rock drilling rig 1 that includes a movable carrier 2 provided with a drilling boom 3. The boom 3 is provided with a rock drilling unit 4 including a feed beam 5, a feed device 6 and a rotation unit 7. The rotation unit 7 may be supported by a carriage 8, or alternatively the rotation unit may include sliding parts or the like support members with which it is movably supported to the feed beam 5. The rotation unit 7 may be provided with drilling equipment 9, which may include one or more drilling tubes 10 connected to each other, and a drill bit 11 at the outermost end of the drilling equipment.

The drilling unit 4 of FIG. 1 is intended for rotary drilling in which the rotation unit 7 is used for rotating the drilling equipment 9 around its longitudinal axis in direction R and, at the same, the rotation unit 7 and the drilling equipment 9 connected to it are fed with feed force F by means of the feed device 6 in drilling direction A. Thus, the drill bit breaks rock due to the effect of rotation R and feed force F, and a drill hole 12 is formed.

When the drill hole 12 has been drilled to a desired depth, the drilling equipment 9 can be pulled out of the drill hole 12 by the feed device 6 in return direction B, and the drilling equipment can be disassembled by unscrewing connection threads between the drilling tubes 10 by means of the rotation unit 7. The drilling equipment 9 may be provided with a separate floating spindle for allowing screwing and unscrewing connection threads of the drilling equipment 9.

Figure 2:
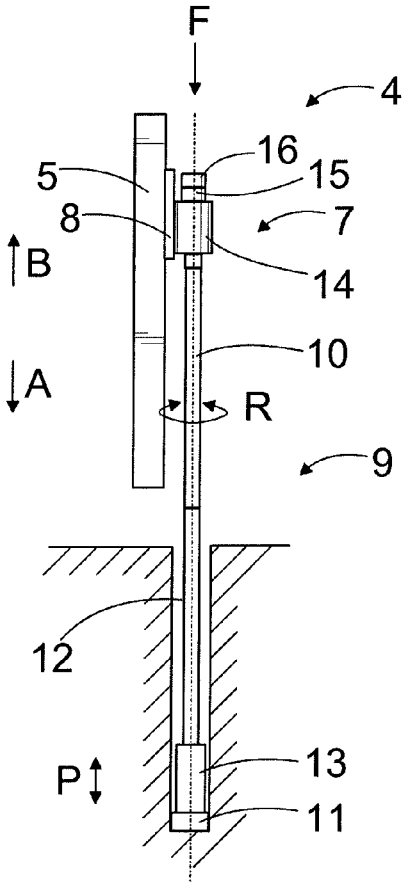
FIG. 2 shows schematically the principle of DTH drilling and the operation of a rotation unit in it.

FIG. 2 shows a second drilling unit 4, which differs from the one in FIG. 1 in such a way that the drilling equipment 9 is provided with a percussion device 13. The percussion device 13 is thus at the opposite end of the drilling equipment 9 in relation to the rotation unit 7. During drilling, the percussion device 13 is in the drill hole, and the drill bit 11 may be connected directly to the percussion device 13. The rotation unit 7 may consist of modules, whereby it may have a basic module 14 with a main shaft and its support elements, as well as a gear system module 15 and a rotating motor module 16. The modules may be arranged successively on the same axial line.

Figure 3:
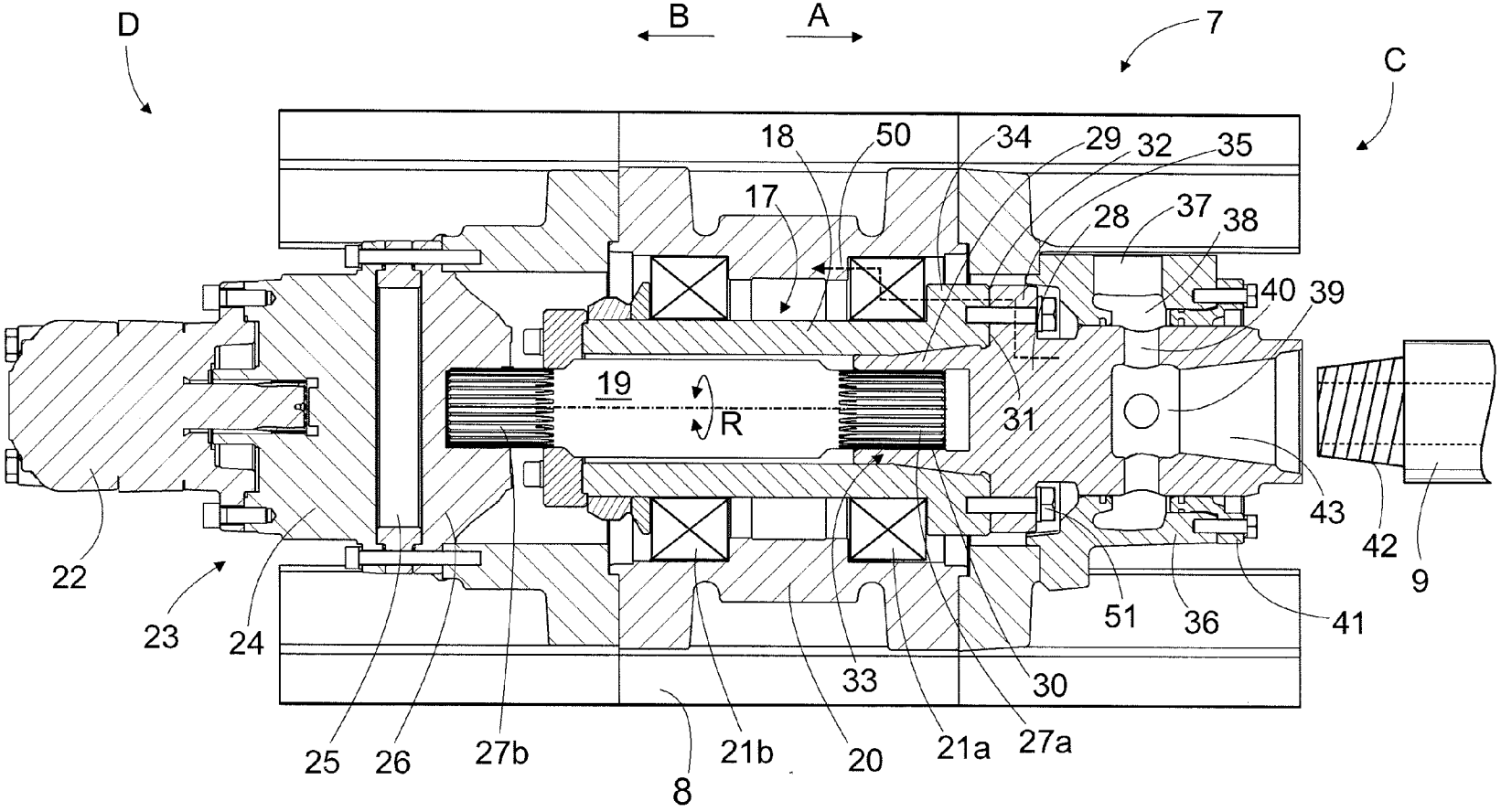
FIG. 3 is a cross-sectional top view of a rotation unit in accordance with the disclosure.

FIG. 3 shows one possible embodiment of the rotation unit 7. The rotation unit 7 has a main shaft 17, which includes an outer shaft 18 and an inner shaft 19. The outer shaft 18 has a tubular configuration and the inner shaft 19 is arranged inside the outer shaft 18. The outer shaft 18 may be supported to a body 20 by two bearings 21*a* and 21*b*, which may serve as radial and axial bearings. The bearings 21*a* and 21*b* are located at an axial distance from each other and they may be roller bearings.

The rotation unit 17 further includes at least one rotation motor 22 for producing needed rotation movement and torque. Rotation may be transmitted by a transmission member 23 to the inner shaft 19. The transmission member 23 may include a gear system 24, such as a planetary gear, which may be connected to rotate the inner shaft 19 through modules 25 and 26, which may include suitable transmission elements.

At a front end C and rear end D of the inner shaft 19 there are rotation transmission portions, which may include splines 27*a* and 27*b*, a set of grooves, or corresponding rotation transmission member. Rotation R and torque is transmitted through the inner shaft 19 to a rotation hub 28 connected at a front end C of the main shaft 17. The rotation hub 28 may serve as an adaptor piece between the main shaft 17 and drilling equipment 9. However, it is also possible that the drilling equipment 9 is provided with suitable connection surfaces and elements allowing it to be connected directly to the rotation unit, whereby no need for the rotation hub exists.

The rotation hub 28 includes at its rear end means for receiving rotation R and torque from the inner shaft 19 and means for fastening to the outer shaft 18 axially. The rear end portion of the rotation hub 28 may include a rear sleeve portion 29, which may be arranged inside the front portion of the outer shaft 18 and includes longitudinal splines 30, or corresponding elements, on an inner surface of the rear sleeve portion 29. The splines 30 of the rotation hub are in contact with splines 27*a* of the inner shaft 19.

The rotation hub 28 may include a first axial fastening surface 31 for fastening the rotation hub 28 to a second axial fastening surface 32 of the outer shaft 18. The rotation hub 28 and the outer shaft 18 may include flanges 34 and 35 provided with the opposing axial fastening surfaces 31 and 32. The fastening surfaces 31 and 32 may be fastened to each other by means of connection screws 51, for example. However, any other suitable fastening arrangements and means may also be utilized.

As can be seen in FIG. 3, the rear sleeve portion 29 is located in an annular space formed between an inner surface of the outer shaft 18 and an outer surface of the inner shaft 19. Further, a connecting point 33 between the inner shaft 19 and the rotation hub 28 is located inside the outer shaft 18, because the front end of the inner shaft 19 is located at a distance from the front end of the outer shaft 18.

The flange 34 at the front end of the outer shaft 18 may also transmit axial forces via the bearings 21*a*, 21*b* to the body 20. Alternatively, the outer surface of the outer shaft 18 may be provided with one or more shoulders, protrusions or other axial surfaces serving as force transmitting surfaces. In FIG. 3 a broken line 50 illustrates how the axial forces are transmitted in the disclosed structure. The bearings 21*a* and 21*b* may be configured to support the outer shaft 18 to the body 20 without axial clearance, whereby no sliding exists in the connecting point 33. Thus, wearing of the rotation transmitting elements may be decreased.

FIG. 3 further shows that around the rotation hub 28 may be a frontal housing 36 allowing feeding of a pressure medium to the drilling equipment 9. The housing 36 may include a feed port 37 and an inner space 38, and the rotation hub 28 may include a central channel 39 and one or more transverse channels 40. The pressure medium may be fed through the feed port 37 to the inner space 38 and via transverse channels 40 to the central channel 39. The drilling equipment 9 may be a drilling tube whereby it receives the pressure medium fed through the central channel 39. At a front end of the housing 36 may be a cover 41, which closes the housing. Drilling equipment 9 may include connecting threads 42 and the front end of the rotation hub 28 may be provided with mating connecting threads 43.

Figure 4:
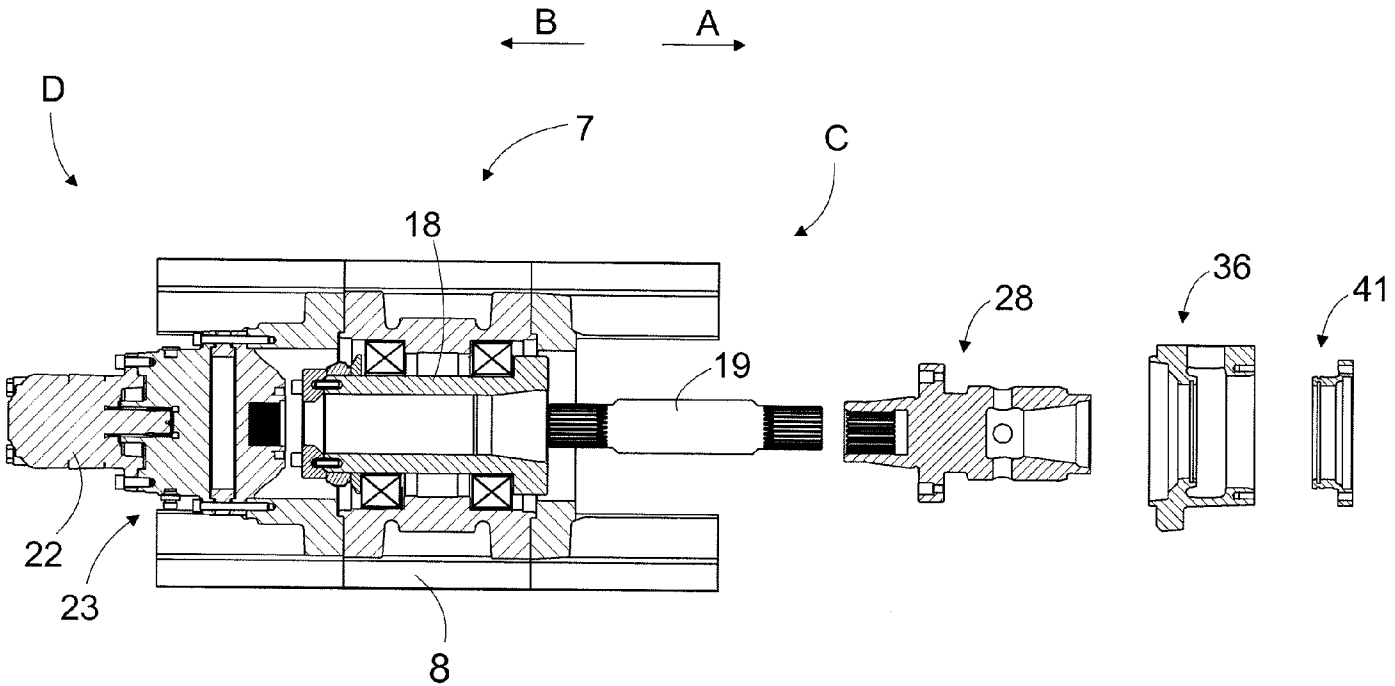
FIG. 4 is a cross-sectional top view of a rotation unit of FIG. 3 and illustrates dismantling of the inner shaft by removing only frontal elements of the rotation unit.

FIG. 4 illustrates dismantling of the rotation unit 7 shown in FIG. 3. In case the inner shaft 19 needs to be inspected or changed, it can be dismantled without the need to dismantle the whole structure of the rotation unit 7. During the dismantling, the rotation unit 7 may remain fastened to the carrier 8 and only the frontal components, such as the cover 41, the housing 36 and the rotation hub 28 needs to be removed. Thereafter, the inner shaft 19 can freely be pulled out. There is no need to remove the outer shaft 18. Furthermore, the rotation motor 22, and the transmission member 23 may be removed and serviced without the need to dismantle the main shaft. Thanks to these features, servicing of the rotation unit may be executed fast and easy at a drilling site.

Figure 5:
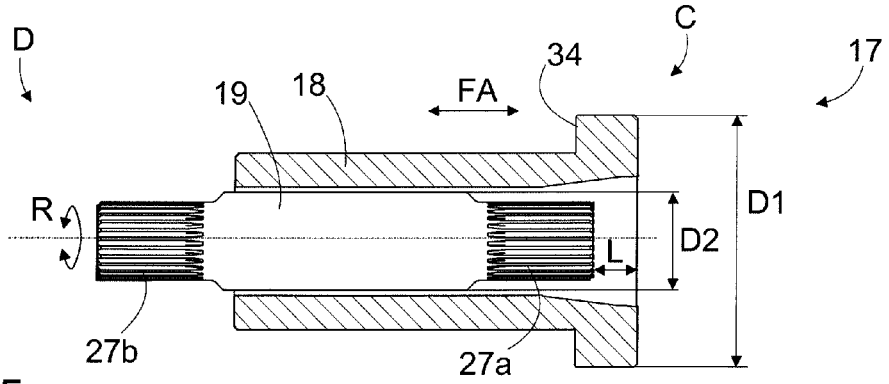
FIG. 5 is a partial cross-sectional view of the main shaft in accordance with the disclosure.

FIG. 5 discloses a main shaft 17 including an outer shaft 18 and an inner shaft 19. The outer shaft 18 may include a flange 34 at a front end C of the main shaft 17. The outer shaft 18 may have a maximum outer diameter D1 at the flange 34. The inner shaft may have a maximum diameter D2 between the splined portions 27*a* and 27*b*. The diameter D1 may be dimensioned to at least double relative to the diameter D2.

FIG. 5 further shows that between front ends of the inner shaft 19 and outer shaft 18 may be a distance L, which may be one third of the diameter D2, for example. FIG. 5 also shows that the outer shaft 18 is dedicated for transmitting axial forces FA, whereas the inner shaft 19 is dedicated to transmit rotation R and torque.

Figure 6:
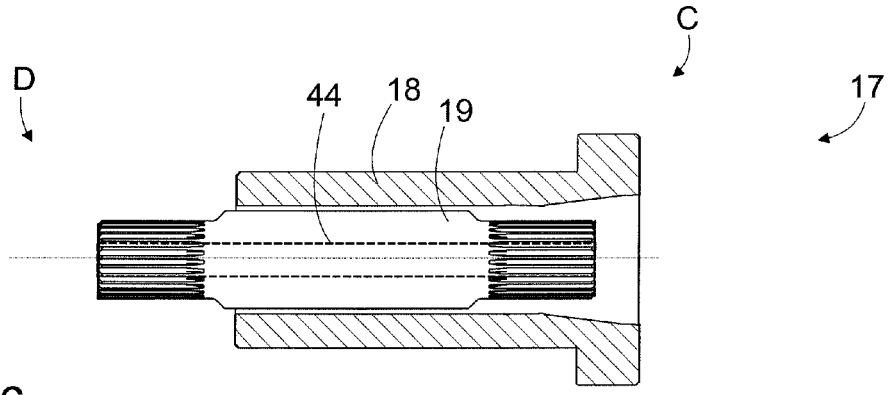
FIG. 6 is a partial cross-sectional view of an alternative main shaft, wherein an inner shaft includes an axial channel allowing flow of pressure medium fluid through the shaft.

FIG. 6 discloses another main shaft structure, which differs from the one shown in FIG. 5 only in that the inner shaft 19 is not a solid piece. Instead the inner shaft 19 includes a longitudinal channel 44, which extends from a front end to a rear end of the inner shaft 19. The channel 44 offers a passage through which pressure medium fluid may be fed. Alternatively, the channel may be utilized in conveyance of drilling samples.

Figure 7:
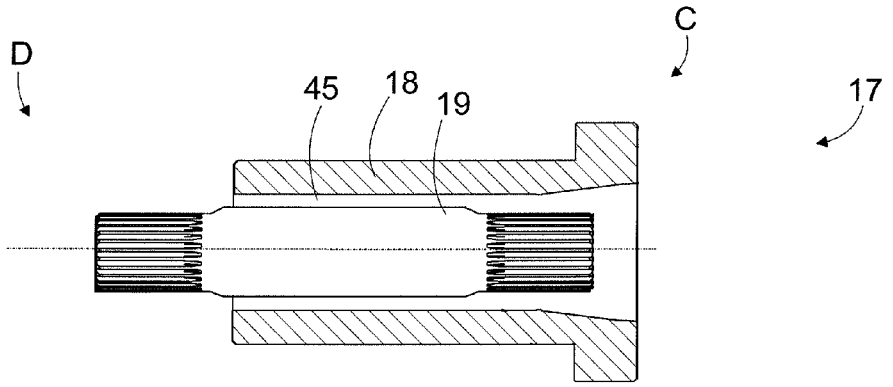
FIG. 7 is a partial cross-sectional view of another main shaft including a longitudinal annular channel allowing flow of pressure medium fluid through the channel between inner and outer shafts.

FIG. 7 discloses yet another main shaft structure, which deviates from the one shown in FIG. 5 only in that between the inner shaft 19 and the outer shaft 18 is a longitudinal annular channel 45. The channel 45 may be used for feeding pressure medium fluid through the main shaft 17.

It should be noted that in the above embodiments the rotating motor may a hydraulic motor or an electric motor. Further, a direct drive motor may also be used in the rotation units 7 shown in FIGS. 3 and 4, in which case, deviating from the solutions of the figures, they have no gear system.

In some cases, features disclosed in this application may be used as such, regardless of other features. On the other hand, when necessary, features disclosed in this application may be combined in order to provide various combinations.

Although the present embodiment(s) has been described in relation to particular aspects thereof, many other variations and modifications and other uses will become apparent to those skilled in the art. It is preferred therefore, that the present embodiment(s) be limited not by the specific disclosure herein, but only by the appended claims.

What is claimed is:

1. A rotation unit for rock drilling, the rotation unit being without a percussion device and comprising:

a body;

a main shaft, which is an elongated piece having a front end having a connection for attaching drilling equipment, and an opposite rear end, the main shaft being supported on the body with bearings rotatable in relation to its longitudinal axis;

at least one rotating motor;

transmission members for transmitting torque from the rotating motor to the main shaft; and axial support surfaces for transmitting axial forces between the body and the main shaft in drilling direction and return direction, wherein the main shaft includes a tubular outer shaft and an inner shaft arranged inside the outer shaft, an outer surface of the outer shaft being provided with axial support surfaces for transmitting the axial forces, and the inner shaft being provided with first transmission members at a rear end for receiving torque from the rotating motor, a front end of the inner shaft being provided with second transmission members for transmitting the torque to the drilling equipment.

2. The rotation unit of claim 1, wherein the front end and the rear end of the inner shaft include longitudinal splines on their outer surfaces thereof, the splines transmitting torque and allowing axial movement.

3. The rotation unit of claim 1, wherein the outer shaft has a first maximum diameter and the inner shaft has a second maximum diameter, the first maximum diameter being at least double relative to the second maximum diameter.

4. The rotation unit of claim 1, wherein the front end of the outer shaft is provided with a flange including an axial fastening surface facing in the drilling direction, wherein the drilling equipment is connectable to the fastening surface.

5. The rotation unit of claim 1, wherein the outer shaft is supported to the body by rolling bearings, the bearings supporting the outer shaft in the radial and axial directions.

6. The rotation unit of claim 1, wherein the front end of the rotation unit is provided with a rotation hub and a front end portion of the rotation hub includes a fastening for fastening the drilling equipment.

7. The rotation unit of claim 6, wherein a rear end portion of the rotation hub includes a rear sleeve portion arranged inside the front portion of the outer shaft and includes longitudinal splines on an inner surface of the rear sleeve portion.

8. The rotation unit of claim 7, wherein the rear end portion of the rotation hub includes a radially protruding flange at a distance from the rear end of the rotation hub, the splines of the rotation hub transmitting torque and the flange transmitting axial forces.

9. The rotation unit of claim 1, wherein the front end of the rotation unit is provided with a rotation hub, the rotation hub including at least one channel for conducting pressure medium to the drilling equipment.

10. A rotation unit for rock drilling, the rotation unit being without a percussion device and comprising:

a body;

a main shaft, which is an elongated piece having a front end having a connection for attaching drilling equipment, and an opposite rear end, the main shaft being supported on the body with bearings rotatable in relation to its longitudinal axis;

at least one rotating motor;

transmission members for transmitting torque from the rotating motor to the main shaft; and axial support surfaces for transmitting axial forces between the body and the main shaft in drilling direction and return direction, wherein the main shaft includes a tubular outer shaft and an inner shaft arranged inside the outer shaft, an outer surface of the outer shaft being provided with axial support surfaces for transmitting the axial forces, and the inner shaft being provided with first transmission members at a rear end for receiving torque from the rotating motor, a front end of the inner shaft being provided with second transmission members for transmitting the torque to the drilling equipment, wherein the rear end of the inner shaft protrudes from the rear end of the outer shaft, and the front end of the inner shaft is located inside the outer shaft at a distance from the front end of the outer shaft.

11. A rotation unit of claim for rock drilling, the rotation unit being without a percussion device and comprising:

a body;

a main shaft, which is an elongated piece having a front end having a connection for attaching drilling equipment, and an opposite rear end, the main shaft being supported on the body with bearings rotatable in relation to its longitudinal axis;

at least one rotating motor;

transmission members for transmitting torque from the rotating motor to the main shaft; and axial support surfaces for transmitting axial forces between the body and the main shaft in drilling direction and return direction, wherein the main shaft includes a tubular outer shaft and an inner shaft arranged inside the outer shaft, an outer surface of the outer shaft being provided with axial support surfaces for transmitting the axial forces, and the inner shaft being provided with first transmission members at a rear end for receiving torque from the rotating motor, a front end of the inner shaft being provided with second transmission members for transmitting the torque to the drilling equipment, wherein the outer shaft is arranged such that axial movement of the outer shaft relative to the body is prevented, and the inner shaft inside the outer shaft is without direct axial connection to the outer shaft.

12. A rock drilling unit comprising:

a rotation unit being without a percussion device, the rotation unit including a main shaft, connection members for attaching drilling equipment to the main shaft, at least one rotating motor for generating rotation and torque, and transmission members for transmitting torque from the rotating motor to the main shaft, wherein the main shaft includes a tubular outer shaft and an inner shaft arranged inside the outer shaft, an outer surface of the outer shaft being provided with axial support surfaces for transmitting axial forces, and the inner shaft being provided with first transmission members at a rear end for receiving torque from the rotating motor, a front end of the inner shaft including second transmission members for transmitting the torque to the drilling equipment;

a feed beam movably supporting the rotation unit in a drilling direction and a return direction; and a feed device for generating feed forces, wherein the drilling equipment includes at least one drilling tube, a first end of the drilling equipment being connected to the rotation unit for transmitting feed forces and torque to the drilling equipment, wherein a free end of the drilling equipment includes a drill bit for breaking rock.

13. A method for drilling rock, comprising the steps of:

drilling rock with a rock drilling unit, the rock drilling unit including a feed beam, a feed device, drilling equipment and at least one rotation unit, the rotation unit being without a percussion device and including a main shaft, connection members for attaching the drilling equipment to the main shaft, at least one rotating motor for generating rotation and torque, and transmission members for transmitting torque from the rotating motor to the main shaft, wherein the main shaft includes a tubular outer shaft and an inner shaft arranged inside the outer shaft, an outer surface of the outer shaft being provided with axial support surfaces for transmitting axial forces, and the inner shaft being provided with first transmission members at a rear end for receiving torque from the rotating motor, a front end of the inner shaft including second transmission members for transmitting the torque to the drilling equipment;

rotating the main shaft of the rotation unit around its longitudinal axis and transmitting torque to the drilling equipment connected to the main shaft, the outermost end of which drilling equipment including a drill bit for breaking rock;

feeding the rotation unit axially by the feed device supported by the feed beam, in a drilling direction and a return direction;

transmitting torque purely through the inner shaft of the main shaft; and transmitting axial forces purely through the outer shaft of the main shaft.

* * * * *